United States Patent [19]

Davis

[11] Patent Number: 4,747,181

[45] Date of Patent: May 31, 1988

[54] DOOR RETAINER

[76] Inventor: Charles L. Davis, 1506 S. Lake Harris Rd., White Oak, Tex. 75693

[21] Appl. No.: 63,452

[22] Filed: Jun. 18, 1987

[51] Int. Cl.[4] ..... E05F 5/00

[52] U.S. Cl. ..... 16/82; 292/DIG. 15

[58] Field of Search ..... 16/82, 86 A, 86 R, DIG. 17, 16/DIG. 21; 292/262, 300, DIG. 15; 296/162; 180/90.6

[56] References Cited

U.S. PATENT DOCUMENTS 2,419,449 4/1947 Hilton ..... 16/86 A

*Primary Examiner*—Nicholas P. Godici
*Assistant Examiner*—Edward A. Brown
*Attorney, Agent, or Firm*—John M. Harrison

[57] ABSTRACT

A door retainer for removably mounting on the folding steps of a recreational vehicle to prevent the door from opening, which door retainer is characterized by a flat step plate designed to fit on the top step of the folding steps and provided with a downwardly-extending rear plate for engaging the rear edge of the top step. A post is upward-standing from the step plate in close proximity to the door, in order to prevent the door from opening when the step plate and the rear plate are installed on the steps in functional position. A latch bracket projects downwardly from fixed attachment to the step plate and a tab slot is provided in the rear plate opposite the latch bracket for receiving a tab located on one end of a keeper plate. The opposite end of the keeper plate is fitted with a keeper bracket for engaging the latch bracket on the step plate and receiving the hasp of a padlock to secure the step plate and the rear plate in functional configuration on the folding steps of the recreational vehicle.

15 Claims, 1 Drawing Sheet

DOOR RETAINER

BACKGROUND OF THE INVENTION

Field of the Invention

This invention relates to locking devices for securing recreational vehicles and more particularly, to a door retainer for mounting on the steps, and the folding steps in particular, of a motorized or non-motorized recreational vehicle, in order to prevent the door from opening and to stop unauthorized entry of the recreational vehicle through the door. The door retainer of this invention is characterized by a flat step plate and a rear plate downwardly extending from the rear edge of the step plate, for engaging the top step of a recreational vehicle and locating a fixed door post, which projects from the step plate, in close proximity to the door of the recreational vehicle, to prevent the door from opening past a predetermined point. The step plate and rear plate are removably mounted on the folding steps of the recreational vehicle by means of a keeper plate provided with an extending tab at one end and an upward-standing keeper bracket at the opposite end. The tab is shaped to insert in a tab slot located in the rear plate and the keeper bracket is designed for locking to a latch bracket that is welded or otherwise secured to the step plate. A padlock is used to secure the keeper bracket to the latch bracket, in order to maintain the step plate on the top step and the door post in close proximity to the door of the recreational vehicle and prevent unauthorized entry through the door.

Recreational vehicles of both the motorized and non-motorized design are typically constructed of a light-weight material such as aluminum an a considerable amount of plastic trim is also used, in order to further promote lightness of weight. Accordingly, these vehicles are not extremely secure and the doors are rather easily forced by burglars and vandals using tools such as a crowbar or hammer, in order to gain entry to the recreational vehicle. While th locks may be constructed of steel, they are normally set in aluminum door jambs and are easily forced through the door jambs by application of force at the lock retainer. Since the windows are provided in most recreational vehicles are quite small, the preferred point of entry for burglars and vandals is usually the door.

Accordingly, it is an object of this invention to provide a new and improved door retainer which is characterized by an upward-standing door post removably secured to the top step of a recreational vehicle in close proximity to the door, in order to prevent the door from opening.

Another object of this invention to provide a new and improved door retainer for recreational vehicles, which door retainer is characterized by a flat step plate and a rear plate extending downwardly from the step plate, with a door post extending upwardly from fixed attachment to the step plate and located in close proximity to the door when the step plate and rear plate are secured to the folding steps of the recreational vehicle.

Yet another object of this invention is to provide a new and improved door retainer which is adapted to removably attach to the top step in the folding steps of a recreational vehicle, which door retainer is characterized by a flat step plate fitted with a downwardly-extending rear plate and an upward-standing door post, wherein the step plate is locked to the top step by means of a keeper plate and padlock, in order to position the door post in close proximity to the recreational vehicle door and prevent forced opening of the door and unauthorized entry of the recreational vehicle.

Still another object of this invention is to provide a door retainer for removably mounting on the top step in the folding steps of both motorized and non-motorized recreational vehicles, which door retainer is characterized by a flat step plate having an upward-standing door post located in close proximity to the recreational vehicle door when the step plate is mounted by means of a keeper plate and padlock on the top step.

SUMMARY OF THE INVENTION

These and other objects of the invention are provided in a new and improved door retainer which is characterized by a flat step plate and downwardly-extending rear plate which are adapted for mounting on the top step of a set of folding steps in a recreational vehicle by means of a cooperating keeper plate and padlock. A rigid door post is welded or otherwise fixedly mounted to the step plate and is oriented in close proximity to the door of the recreational vehicle when the step plate is mounted on the top step, in order to prevent forcible opening of the door past a predetermined point. The keeper plate is fitted at one end with a tab which engages a slot in the rear plate and a keeper bracket located at the opposite end of the keeper plate engages a latch bracket attached to the step plate, such that the keeper plate and a padlock securing the keeper bracket and latch bracket are positioned beneath the top step to prevent cutting of the padlock hasp by bolt cutters.

BRIEF DESCRIPTION OF THE DRAWINGS

The invention will be better understood by reference to the accompanying drawings, wherein.

DESCRIPTION OF THE PREFERRED EMBODIMENTS

Figure 1:
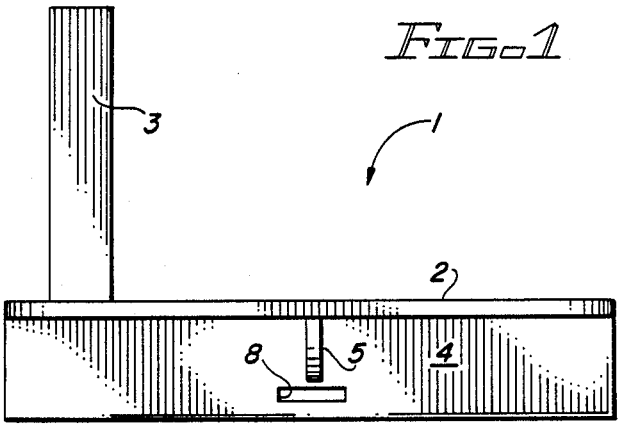
FIG. 1 is a front elevation of a preferred embodiment of the door retainer of this invention.
Figure 3:
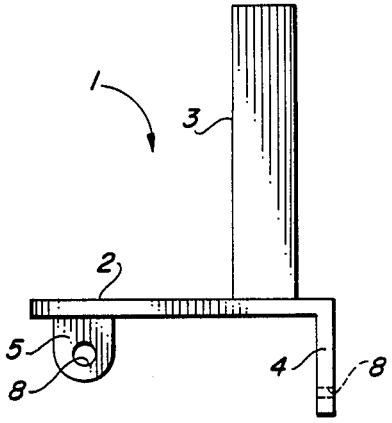
FIG. 3 is a side elevation of the door retainer illustrated in FIGS. 1 and 2.
Figure 4:
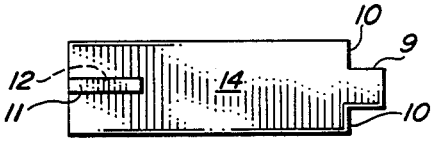
FIG. 4 is a top elevation of a preferred keeper plate for securing the door retainer to the folding steps of a recreational vehicle.
Figure 5:
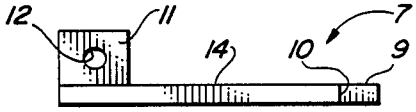
FIG. 5 is a side elevation of the keeper plate illustrated in FIG. 4.
Figure 6:
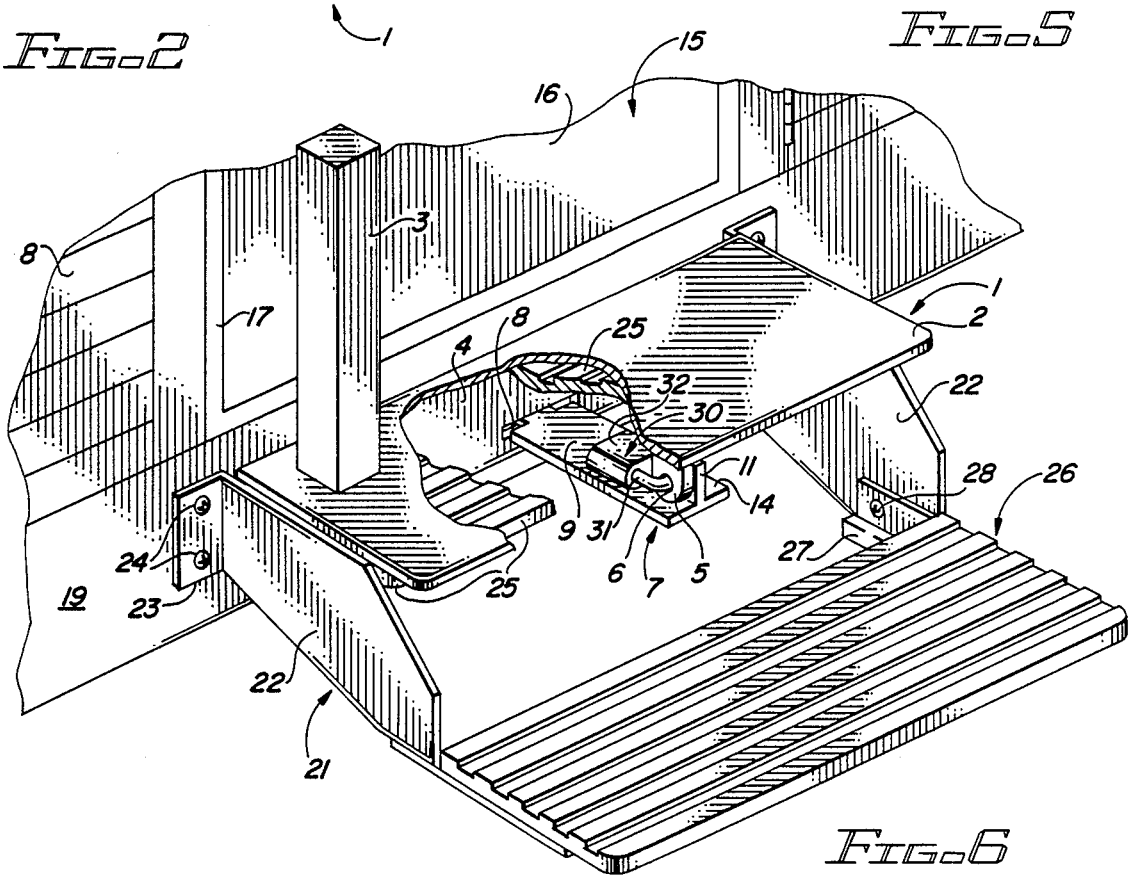
FIG. 6 is a perspective view of the door retainer of this invention mounted in functional configuration on the top step in the folding steps of a recreational vehicle.

Referring to the drawing, the door retainer of this invention is generally illustrated by reference numeral 1. The door retainer 1 is characterized by a flat step plate 2, provided with a door post 3 which is welded or otherwise secured to the step plate 2 in an upward-standing, fixed relationship. As illustrated in FIG. 6, the door post 3 projects perpendicularly upwardly from the step plate 2 near one edge thereof, in close proximity to the recreational vehicle door 16 of a recreational vehicle 15. A rear plate 4 extends downwardly in fixed relationship from the rear edge of the step plate 2 and is designed to engage the rear edge of a top step 25 in the folding steps 21, which serve the recreational vehicle 15, as illustrated in FIGS. 1 and 6. A latch bracket 5 projects downwardly from fixed attachment to the step plate 2 near the fron edge of the step plate 2 and is provided with a latch bracket eye 6, as illustrated in FIGS. 3 and 6. Furthermore, a tab slot 8 is cut or otherwise provided in the rear plate 4 immediately opposite the latch bracket 5, in order to receive a keeper tab 9, which projects from one end of a keeper plate 7, illustrated in FIGS. 4 and 5. The keeper tab 9 extension from the keeper plate body 14 defines a pair of tab shoulders 10, which are designed to engage the rear plate 4 on opposite sides of the tab slot 8 when the keeper tab 9 is inserted in the tab slot 8, as illustrated in FIG. 6. A keeper bracket 11 extends upwardly from the opposite end of the keeper plate body 14 in fixed relationship and is provided with a keeper bracket eye 12, which is designed to register with the latch bracket eye 6 of the latch bracket 5, when the door retainer 1 is mounted in functional, locked configuration on the top step 25 of the folding steps 21 in the recreational vehicle 15, as illustrated in FIG. 6.

Referring again to FIG. 6 of the drawing, the door retainer 1 is mounted in locked configuration on the top step 25 in the steps 21 of the recreational vehicle 15, by initially placing the step plate 2 flat against the top step 25. When the step plate 2 is oriented in this position, the rear plate 4 extends downwardly behind the rear edge of the top step 25 and the door post 3 projects upwardly in close proximity to the recreational vehicle door 16 to prevent the recreational vehicle door 16 from opening beyond a predetermined point before striking the door post 3. The keeper plate 7 is then positioned beneath the top step 25, with the keeper tab 9 inserted in the tab slot 8 located in the rear plate 4 and the upward-standing keeper bracket 11 aligned with the downwardly-extending latch bracket 5, which is welded or otherwise attached to the step plate 2. When this alignment of the latch bracket 5 and the keeper bracket 11 is achieved, the latch bracket eye 6, located in the latch bracket 5, and the keeper bracket eye 12, provided in the keeper bracket 11, are also aligned. The hasp 31 of a padlock 30 is then inserted through the registering latch bracket eye 6 and keeper bracket eye 12 and secured in the receiver 32 of the padlock 30, to lock the keeper plate 7 to the step plate 2 and the rear plate 4, as illustrated. When the padlock 30 is positioned in locked configuration beneath the step plate 2 and the top step 25 of the folding steps 21, there is insufficient room between the top step 25 and bottom step 26 to facilitate cutting the hasp 31 with bolt cutters or other mechanical means and the door retainer 1 is secured on the top step 25 of the folding steps 21 until the padlock 30 is unlocked. The padlock 30 can be easily unlocked by reaching beneath the top step 25 and inserting a key (not illustrated) in the receiver 32 of the padlock 30, to remove the hasp 31 from the aligned latch bracket eye 6 and keeper bracket eye 12, in order to facilitate removal of the door retainer 1 from the folding steps 21.

It will be appreciated by those skilled in the art that since the folding steps 21 are securely attached to the recreational vehicle frame 19 as illustrated in FIG. 6, access to the recreational vehicle 15 through the recreational vehicle door 16 is prevented when the door retainer 1 is installed on the top step 25. Furthermore, conventional folding steps such as the folding steps 21 are used in most recreational vehicles 15 and are characterized by parallel step frames 22, terminated at one end by frame flanges 23 that are welded or attached by means of flange bolts 24 to the recreational vehicle frame 19. The top step 25 is welded or otherwise secured to the step frames 22 and the wall 18 of the recreational vehicle 15 extends upwardly from the recreational vehicle door 16 in the wall 18. The bottom step 26 of the folding steps 21 is typically attached in pivoting or sliding relationship to a pair of bottom step braces 27, which are mounted to the step frames 22 and a hinge pin 28 is used to mount the bottom step brace 27 to the step frames 22 in conventional folding relationship.

It will be further appreciated by those skilled in the art that the door retainer of this invention can be constructed of steel or aluminum plate of substantially any thickness and size, depending upon the size and configuration of the folding steps 21. In a preferred embodiment of this invention, the step plate 2 is about 23 inches long by 10½ inches wide and is constructed of ⅛ inch steel plate. The rear plate 4 and keeper plate 7 are constructed of similar stock and the upward-standing door post 3 is typically constructed of 2-inch by 2-inch square steel or aluminum tubing of suitable thickness.

Figure 2:
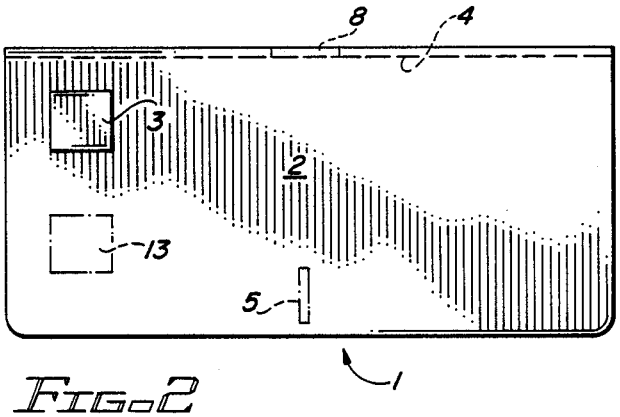
FIG. 2 is a top elevation of the door retainer illustrated in FIG. 1.

Referring again to FIG. 2 of the drawings, it will be appreciated that an alternate door post position 13 can be utilized under circumstances where the folding steps 21 of the recreational vehicle 15 are designed such that the door post 3 must be positioned farther forwardly on the step plate 2 than the position illustrated in FIG. 1. Accordingly, it is understood that the position and location of the door post 3 on the step plate 2 is a matter of choice, depending upon the design of the folding steps 21, in order to locate the door post 3 in a desired proximity with respect to the recreational vehicle door 16.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A door retainer for mounting on a door step and blocking the door of a recreational vehicle, comprising a step plate adapted to fit on the door step; door stop means fixedly carried by said step plate in close proximity to the door; a rear plate downwardly extending from said step plate in fixed relationship, said rear plate engaging an edge of the door step; and keeper means extending beneath the door step, said keeper means releasably connected to both said step plate and said rear plate for securing said step plate on the door step and preventing the door from opening past a predetermined point.

2. The door retainer of claim 1 further comprising a slot provided in said rear plate and a latch bracket fixedly attached to said step plate, said latch bracket projecting from said step plate in spaced relationship with respect to said slot and wherein said keeper means further comprises an elongated keeper plate disposed beneath said step plate and the door step; a tab projecting from one endof said keeper plate, said tab adapted for removably engaging said slot; a keeper bracket projecting from the opposite end of said keeper plate for removably engaging said latch bracket; and lock means engaging said latch bracket and said keeper bracket for removably securing said keeper plate to said latch bracket and said rear plate.

3. The door retainer of claim 2 further comprising a latch bracket eye provided in said latch bracket and a keeper bracket eye provided in said keeper bracket and wherein said lock means further comprises a padlock having a hasp sized for registration with said keeper bracket eye and said latch bracket eye, for selectively locking said latch bracket to said keeper bracket.

4. The door retainer of claim 1 wherein said door stop means further comprises a post upward-standing from said step plate for blocking outward travel of the door.

5. The door retainer of claim 4 further comprising a slot provided in said rear plate and a latch bracket fixedly attached to said step plate, said latch bracket projecting from said plate in spaced relationship with respect to said slot and wherein said keeper means further comprises an elongated keeper plate disposed beneath said step plate and the door step; a tab projecting from one end of said keeper plate, said tab adapted for removably engaging said slot; a keeper bracket projecting from the opposite end of said keeper plate for removably engaging said latch bracket; and lock means engaging said latch bracket and said keeper bracket for removably securing said keeper plate to said latch bracket and said rear plate.

6. The door retainer of claim 5 further comprising a latch bracket eye provided in said latch bracket and a keeper bracket eye provided in said keeper bracket and wherein said lock means further comprises a padlock having a hasp sized for registration with said keeper bracket eye and said latch bracket eye and selectively locking said latch bracket to said keeper bracket.

7. A door retainer for mounting on the top door step of a recreational vehicle having a vehicle door normally opening over the top door step, said door retainer comprising a step plate adapted to fit on the top door step; door stop means fixedly carried by said step plate, said door stop means oriented in close proximity to the closed vehicle door; a latch bracket extending downwardly from said step plate in fixed relationship; a rear plate downwardly extending in fixed relationship from said step plate rearwardly of said latch bracket, said rear plate engaging the rear edge of the top door step and engaging means provided in said rear plate; keeper means disposed beneath the top door step, said keeper means adapted for releasibly engaging said engaging means in said rear plate and said latch bracket for securing said step plate on the step and preventing the vehicle door from opening past a predetermined point.

8. The door retainer of claim 7 wherein said engaging means further comprises a slot provided in said rear plate and wherein said keeper means further comprises a keeper plate disposed beneath said step plate and the door step; a tab provided on one end of said keeper plate, said tab adapted for removably engaging said slot; a keeper bracket carried by the opposite end of said keeper plate; and further comprising lock means engaging said latch bracket and said keeper bracket for removably securing said keeper plate to said latch bracket and said rear plate.

9. The door retainer of claim 8 further comprising a latch bracket eye provided in said latch bracket and a keeper bracket eye provided in said keeper bracket and wherein said lock means is a padlock having a hasp sized for registration with said keeper bracket eye and said lock bracket eye, for selectively locking said latch bracket to said keeper bracket.

10. A door retainer for mounting on the top step of a recreational vehicle and blocking an outwardly-swinging, exterior door in the recreational vehicle, comprising a step plate adapted for mounting on the top step; a rear plate downwardly extending from said step plate in fixed relationship, said rear plate positioned against the rear edge of the top step when said plate is plaed on the top step; a post extending upwardly in fixed relationship from said step plate, said post located in close proximity to the door and preventing the door from opening past a pre-determined point; and keeper means located beneath said step plate and the door, said keeper means releasably connected to both said step plate and said rear plate, for securing said steep plate on the top step and said post in blocking relationship with respect to the door.

11. The door retainer of claim 10 further comprising a slot provided in said rear plate and a downwardly-extending latch bracket fixedly carried by said step plate in spaced relationship with respect to said slot; and wherein said keeper means further comprises a keeper plate disposed between said slot and said latch bracket, a tab projecting from one end of said keeper plate for engaging said slot and a keeper bracket provided on the opposite end of said keeper plate for engaging said latch bracket; and lock means adapted to engage said keeper bracket and said latch bracket for selectively locking said keeper plate to said rear plate and said latch bracket.

12. The door retainer of claim 11 further comprising a latch bracket eye provided in said latch bracket and a keeper bracket eye provided in said keeper bracket and wherein said lock means further comprises a padlock having a hasp sized for registration with said keeper bracket eye and said latch bracket eye, for selectively locking said latch bracket to said keeper bracket.

13. A door retainer for mounting on the top step of the folding steps of a recreational vehicle and blocking an exterior door normally outwardly-swinging over the top step in the receational vehicle, said door retainer comprising a step plate for mounting on the top step; a rear plate downwardly extending from one edge of said step plate in fixed relationship, said rear plate positioned against the rear edge of the top step when said step plate is placed on the top step; a post extending upwardly in fixed relationship from said step plate, said post located in close proximity to the door and preventing the door from opening past a pre-determined point; and keeper means located beneath said step plate and the door, said keeper means releasably connected to both said step plate and said rear plate, for securing said step plate on the top step and said post in blocking relationship with respect to the door.

14. The door retainer of claim 13 further comprising a slot provided in said rear plate and a latch bracket fixedly attached to said step plate, said latch bracket projecting from said step plate in spaced relationship with respect to said slot and wherein said keeper means further comprises an elongated keeper plate disposed beneath said step plate and the door step; a tab projecting from one end of said keeper plate, said tab adapted for removably engaging said slot; a keeper bracket projecting from the opposite end of said keeper plate for removably engaging said latch bracket; and lock means engaging said latch bracket and said keeper bracket for removably securing said keeper plate to said latch bracket and said rear plate.

15. The door retainer of claim 14 further comprising a latch bracket eye provided in said latch bracket and a keeper bracket eye provided in said keeper bracket and wherein said lock means further comprises a padlock having a hasp sized for registration with said keeper bracket eye and said latch bracket eye and selectively locking said latch bracket to said keeper bracket.

* * * * *